US008070887B2

(12) United States Patent
Asahi et al.

(10) Patent No.: US 8,070,887 B2
(45) Date of Patent: Dec. 6, 2011

(54) HIGH-STRENGTH STEEL SHEET AND HIGH-STRENGTH STEEL PIPE EXCELLENT IN DEFORMABILITY AND METHOD FOR PRODUCING THE SAME

(75) Inventors: Hitoshi Asahi, Futtsu (JP); Yasuhiro Shinohara, Futtsu (JP); Takuya Hara, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 543 days.

(21) Appl. No.: 10/410,014

(22) Filed: Apr. 9, 2003

(65) Prior Publication Data

US 2003/0217795 A1 Nov. 27, 2003

(30) Foreign Application Priority Data

Apr. 9, 2002 (JP) ..... 2002-106536

(51) Int. Cl.
*C21D 9/08* (2006.01)
*C22C 38/00* (2006.01)
*C22C 38/18* (2006.01)

(52) U.S. Cl. ..... 148/320; 148/653; 148/521; 148/593; 420/83; 420/104

(58) Field of Classification Search ..... 148/320, 148/593, 653, 521; 420/127, 126, 83, 104
See application file for complete search history.

(56) References Cited

U.S. PATENT DOCUMENTS

| | | | | |
|---|---|---|---|---|
| 4,591,396 | A * | 5/1986 | Mazuda et al. | 148/505 |
| 5,531,842 | A | 7/1996 | Koo et al. | |
| 5,653,826 | A | 8/1997 | Koo et al. | |

FOREIGN PATENT DOCUMENTS

| | | | |
|---|---|---|---|
| JP | 406017125 | * | 1/1994 |
| JP | 6-136482 | | 5/1994 |
| JP | 406322477 | * | 11/1994 |
| JP | 8-199291 | | 8/1996 |
| JP | 408209287 | * | 8/1996 |
| JP | 09003591 | | 1/1997 |
| JP | 09049050 | | 2/1997 |
| JP | 10158778 | | 6/1998 |
| JP | 410265844 | * | 10/1998 |
| JP | 01073085 | | 3/2001 |
| JP | 2001-288512 | | 10/2001 |
| JP | 2003055737 | * | 2/2003 |

OTHER PUBLICATIONS

Present and Future Steel Tube Manufacturing Technology; Published by *The Iron and Steel Institute of Japan*; 1986, p. 220.
European Patent Office search report for corresponding European Application No. EP03007396.

* cited by examiner

*Primary Examiner* — Jessee R. Roe
(74) *Attorney, Agent, or Firm* — Baker Botts LLP

(57) ABSTRACT

The present invention provides a line pipe of, e.g., the API standard X60 to X100 class. The line pipe has an excellent deformability, as well as excellent low temperature toughness and high productivity, a steel plate used as the material of the steel pipe. Methods for producing the steel pipe and the steel plate are also provided. In particular, a high-strength steel plate excellent in the deformability has a ferrite phase is dispersed finely, and accounts for 5% to 40% in area percentage in a low temperature transformation structure mainly composed of a bainite phase. For example, most grain sizes of the ferrite phase are smaller than the average grain size of the bainite phase. A high-strength steel pipe excellent in deformability is also provided, in which a large diameter steel pipe is produced through forming the steel plate into a pipe shape. The steel pipe has the above-referenced structure, and satisfies the conditions that YS/TS is 0.95 or less and YS×uEL is 5,000 or more. Methods for producing such steel plate and steel pipe are also provided.

3 Claims, 1 Drawing Sheet

HIGH-STRENGTH STEEL SHEET AND HIGH-STRENGTH STEEL PIPE EXCELLENT IN DEFORMABILITY AND METHOD FOR PRODUCING THE SAME

CROSS-REFERENCE TO RELATED APPLICATION

The present application claims priority under 35 U.S.C. §119 from Japanese Patent Application No. 2002-106536, filed on Apr. 9, 2002, the entire disclosure of which is incorporated herein by reference.

FIELD OF THE INVENTION

The present invention relates to a steel pipe widely usable as a line pipe for transporting natural gas and crude oil, and having a large tolerance for a deformation of a pipeline caused by ground movement and the like, and to a steel sheet used as the material of the steel pipe.

BACKGROUND INFORMATION

The importance of pipelines as a way of a long-distance transportation of crude oil and natural gas has increased. However, as the environment in which pipelines are constructed has diversified, problems have arisen in relation to the displacement and bending of pipelines in frozen soil regions caused by seasonal fluctuation of a ground level, the bending of pipelines laid on sea bottoms caused by water current, the displacement of pipelines caused by seismic ground movement, etc. As a consequence, a steel pipe that is excellent in the deformability, and not susceptible to buckling and the like in the case of deformation, has been desired. A large uniform elongation and a large work hardening coefficient are generally regarded as indices of good deformability.

As disclosed in Japanese Patent Publication No. S63-286517 entitled "Method for Producing Low-yield-ratio, High-tensile Steel" and Japanese Patent Publication No. H11-279700 entitled "Steel Pipe Excellent in Buckling Resistance and Method for Producing the Same", the entire disclosures of which are incorporated herein by reference, certain methods have been described for lowering a yield ratio (e.g., raising a work hardening coefficient) by rolling and then cooling (in air to the $Ar_3$ transformation temperature or below) to form ferrite, and then performing rapid cooling to form a dual-phase structure. The proposed methods may, however, be unsuitable for a line pipe material of which good low temperature toughness is preferred if not required. Such method may present another problem of low productivity when the process of cooling in air is included. In view of such problem, a line pipe having a good deformability (a large uniform elongation), with high productivity to allow use for long-distance pipelines and low temperature toughness to allow use in cold regions not impaired, has been sought.

SUMMARY OF THE INVENTION

The present invention relates to a line pipe of, e.g., the API standard X60 to X100 class. This exemplary line pipe preferably has excellent deformability, as well as excellent low temperature toughness, and high productivity. The present invention also relates to a steel plate used as the material of the steel pipe, and to the methods for producing the steel pipe and the steel plate.

The concepts of the present invention, which are presented for solving the above-describe problems, are provided below.

In particular, an exemplary embodiment of a high-strength steel plate excellent in deformability is provided, in which a ferrite phase is dispersed finely and accounts for 5 to 40% in area percentage in a low temperature transformation structure, which is composed of a bainite phase. For example, most grain sizes of the ferrite phase are smaller than the average grain size of said bainite phase.

Such steel plate excellent in deformability contains, in its chemical composition, in mass, e.g.:

C: 0.03 to 0.12%,
Si: 0.8% or less,
Mn: 0.8 to 2.5%,
P: 0.03% or less,
S: 0.01% or less,
Nb: 0.01 to 0.1%,
Ti: 0.005 to 0.03%,
Al: 0.1% or less, and
N: 0.008% or less, so as to satisfy the expression Ti−3.4N>=0; and in addition one or more of
Ni: 1% or less,
Mo: 0.6% or less,
Cr: 1% or less,
Cu: 1% or less,
V: 0.1% or less,
Ca: 0.01% or less,
REM: 0.02% or less, and
Mg: 0.006% or less, with the balance consisting of iron and unavoidable impurities.

According to another exemplary embodiment of the present invention. another high-strength steel pipe excellent in deformability is provided, such that the ratio (YS/TS) of yield strength (YS) to tensile strength (TS) can be 0.95 or less; and the product (YS×uEL) of yield strength (YS) and uniform elongation (uEL) may be 5,000 or more. The base material of such steel pipe has a structure in which a ferrite phase is dispersed finely and accounts for 5 to 40% in area percentage in a low temperature transformation structure, which is composed of a bainite phase. For example, most grain sizes of the ferrite phase are smaller than the average grain size of the bainite phase. In one variant of the present invention, the base material of the steel pipe may contain, in its chemical composition, in mass:

C: 0.03 to 0.12%,
Si: 0.8% or less,
Mn: 0.8% to 2.5%,
P: 0.03% or less,
S: 0.01% or less,
Nb: 0.01 to 0.1%,
Ti: 0.005 to 0.03%,
Al: 0.1% or less, and
N: 0.08% or less, so as to satisfy the expression Ti−3.4N>=0; and in addition, one or more of
Ni: 1% or less,
Mo: 0.6% or less,
Cr: 1% or less,
Cu: 1% or less,
V: 0.1% or less,
Ca: 0.01% or less,
REM: 0.02% or less, and
Mg: 0.006% or less, with the balance consisting of iron and unavoidable impurities.

According to yet another exemplary embodiment of the present invention, a method for producing a high-strength steel plate excellent in deformability is provided. In this method, a steel slab is utilized that contains, in mass:

C: 0.03 to 0.12%,
Si: 0.8% or less,

Mn: 0.8% to 2.5%,
P: 0.03% or less,
S: 0.01% or less,
Nb: 0.01 to 0.1%,
Ti: 0.005 to 0.03%,
Al: 0.1% or less, and
N: 0.08% or less, so as to satisfy the expression Ti−3.4N>=0; and in addition, one or more of:
Ni: 1% or less,
Mo: 0.6% or less,
Cr: 1% or less,
Cu: 1% or less,
V: 0.1% or less,
Ca: 0.01% or less,
REM: 0.02% or less, and
Mg: 0.006% or less, with the balance consisting of iron and unavoidable impurities.

In this exemplary embodiment, the steel slab is subjected to a group of processes which comprise the steps of, e.g., reheating to the austenitic temperature range; thereafter, rough rolling within the recrystallization temperature range; subsequently, finish rolling at a cumulative reduction ratio of 50% or more within the unrecrystallization temperature range of 900° C. or lower; lightly accelerated cooling at a cooling rate of 5 to 20° C./sec. from a temperature not lower than the $Ar_3$ transformation point to a temperature of 500° C. to 600° C.; and, immediately thereafter, heavily accelerated cooling at a cooling rate of 15° C./sec. or more and greater than the cooling rate of the previous cooling to a temperature not higher than 300° C.

According to still another exemplary embodiment of the present invention, a method for producing a high-strength steel plate excellent in deformability is provided. In this exemplary embodiment, a steel slab is also used which contains, in mass:

C: 0.03 to 0.12%,
Si: 0.8% or less,
Mn: 0.8% to 2.5%,
P: 0.03% or less,
S: 0.01% or less,
Nb: 0.01 to 0.1%,
Ti: 0.005 to 0.03%,
Al: 0.1% or less, and
N: 0.08% or less, so as to satisfy the expression Ti−3.4N>=0; and in addition, one or more of:
Ni: 1% or less,
Mo: 0.6% or less,
Cr: 1% or less,
Cu: 1% or less,
V: 0.1% or less,
Ca: 0.01% or less,
REM: 0.02% or less, and
Mg: 0.006% or less, with the balance consisting of iron and unavoidable impurities.

Such exemplary steel slab is subjected to a group of processes which comprise the steps of reheating to the austenitic temperature range; thereafter, rough rolling within the recrystallization temperature range; subsequently, finish rolling at a cumulative reduction ratio of 50% or more within the unrecrystallization temperature range of 900° C. or lower; lightly accelerated cooling at a cooling rate of 5 to 20° C./sec. from a temperature not lower than the $Ar_3$ transformation point to a temperature of 500° C. to 600° C.; then, after holding the rolled steel plate at a constant temperature or letting it cool in air for 30 sec. or less, heavily accelerated cooling at a cooling rate of 15° C./sec. or more and greater than the cooling rate of the previous cooling to a temperature not higher than 300° C.

According to still another exemplary embodiment of the present invention, a steel sheet is produced by into a pipe shape; and then the seam portion is welded. The pipe can be produced using an UOE process and/or a bending roll method.

In yet another exemplary embodiment of the present invention, a method is provided for producing a high-strength hot-rolled steel strip excellent in deformability, in which a steel slab contains, in mass, e.g.:

C: 0.03 to 0.12%,
Si: 0.8% or less,
Mn: 0.8% to 2.5%,
P: 0.03% or less,
S: 0.01% or less,
Nb: 0.01 to 0.1%,
Ti: 0.005 to 0.03%,
Al: 0.1% or less, and
N: 0.08% or less, so as to satisfy the expression Ti−3.4N>=0; and in addition, one or more of:
Ni: 1% or less,
Mo: 0.6% or less,
Cr: 1% or less,
Cu: 1% or less,
V: 0.1% or less,
Ca: 0.01% or less,
REM: 0.02% or less, and
Mg: 0.006% or less, with the balance consisting of iron and unavoidable impurities.

Such steel slab can be subjected to a group of processes which perform the following steps: reheating the slab to the austenitic temperature range; then, rough rolling the slab within the recrystallization temperature range; followed by, completing the rolling of the slab at a cumulative reduction ratio of 50% or more within the unrecrystallization temperature range of 900° C. or lower; lightly accelerated cooling at a cooling rate of 5 to 20° C./sec. from a temperature not lower than the $Ar_3$ transformation point to a temperature of 500° C. to 600° C.; thereafter, heavily accelerated cooling of the slab at a cooling rate of 15° C./sec. or more to a temperature not higher than 300° C., and then cooling the slab.

In addition, a hot-rolled steel strip can be further produced by such exemplary method into a cylindrical shape by a roll forming method, and then welding a butt portion of the strip by high-frequency resistance welding or laser welding.

BRIEF DESCRIPTION OF THE DRAWINGS

FIG. 1(*b*) is another exemplary illustration of a micrograph of a further steel plate according to the present invention.

DETAILED DESCRIPTION

Figure 1A:
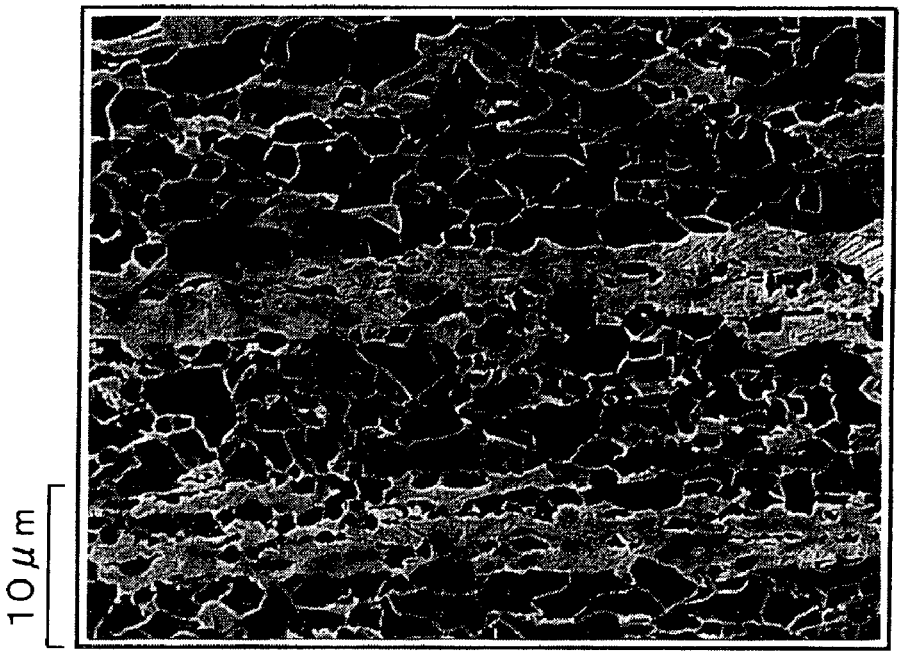
FIG. 1(*a*) is an exemplary illustration of a micrograph of a steel plate produced according to the present invention.
Figure 1B:
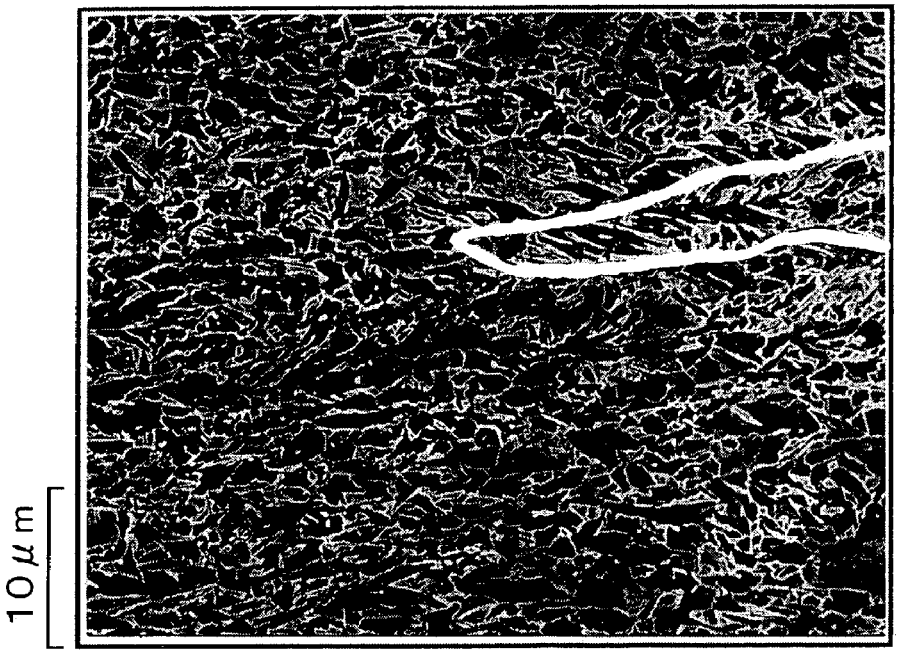

For realizing a high deformability of a metal sheet, it is preferable, in relation to the conventional technologies, to obtain a dual-phase structure, such that a soft phase exists in the structure of a steel material. Upon the examination of the problems of conventional technologies in detail, it was ascertained that when a steel material was cooled in air to the $Ar_3$ transformation point or below after rolling, a coarse ferrite or a lamellar ferrite was formed which caused a separation to occur at a Charpy test fracture surface, and, as a consequence, the absorbed energy decreased was. For example, as shown in FIG. 1(*a*), dark grains represent ferritic structure and gray portions represent bainitic structure. A substantially identical structure can also be formed when a steel plate is produced in the same manner as the comparative examples described herein below. Furthermore, it was determined that the conventional technologies use a particular waiting time until a steel plate is cooled in the air to a prescribed temperature, and thus such conventional technologies are inapplicable for the case of producing a large amount of the product, such as, e.g., a line pipe.

In addition, certain methods for obtaining a dual-phase structure composed of a ferrite phase and a bainite phase have been reviewed, and it was determined that when steel was cooled at a particular cooling rate, comparatively fine ferrite were formed inside the crystal grains and at grain boundaries. When the steel was rapidly cooled thereafter to form a low temperature transformation structure mainly composed of a bainite phase, the difference in the hardness between the structure thus obtained and the ferrite phase became large. As a result, both a high uniform elongation and a high strength may be realized. In addition, the separation at a Charpy test can be suppressed, and a high absorbed energy may be obtained.

In order to avoid the deterioration of low temperature toughness, it is preferable for the dispersed ferrite to exist as shown, e.g., in FIG. 1(*b*); which illustrates that neither the coarse ferrite nor the ferrite exists in the form of lamellar tiers. It is preferable for most of the ferrite grains to be finer than the bainite grains that constitute the matrix phase. Otherwise, the deterioration of toughness caused by the formation of ferrite becomes conspicuous. Due to the fact that most of the ferrite grains are finer than the bainite grains that constitute the matrix phase, the percentage of the ferrite grains larger than the average size of bainite grains is preferably 10% or less in the ferrite phase.

In terms of actual numerical size, it is preferable for most of the ferrite grains to be several micrometers in size, e.g., mostly 10 μm or less. For example, as shown in FIG. 1(*b*), the portion encircled by a white solid line indicates that the grain size of the bainitic structure and the black particles are ferrite grains. This constitution is substantially identical to the one obtained in the example described herein below. If the amount of a ferrite phase is below 5% in terms of area percentage, the effect of improving uniform elongation is likely not obtained. However, if its amount is so large as to exceed 40%, the high strength is likely not realized. For such reason, the area percentage of a ferrite phase can be defined to be from 5% to 40%.

In addition, the reasons for limiting the amounts of the component chemical elements are provided herein below. Any of the amounts of the component chemical elements in the description below is provided in mass percentages.

According to an exemplary embodiment of the present invention, the amount of C can be 0.03% to 0.12% of the sheet. Carbon is very effective for increasing steel strength. Accordingly, for obtaining a desired strength, it should preferably be added to be at least 0.03%. When the amount of C is too large, however, low temperature toughness of a base material and a HAZ and weldability are likely deteriorated. For such reason, the upper limit of the amount of C can be set at 0.12%. The larger the amount of C, the higher the uniform elongation becomes, and, the smaller the amount of C, the better the low temperature toughness and weldability become. Thus, it is preferable to determine the appropriate amount of C in consideration of a balance of certain desired characteristics.

Si is an element which can be added for a deoxidation and an improvement of strength of the sheet. However, when Si is added in a large quantity, HAZ toughness and field weldability may deteriorate. For such reason, the upper limit of its amount may be set at 0.8% of the sheet. Steel can be well deoxidized using Al or Ti and, in this sense, it is not always necessary to add Si. However, for stably obtaining a deoxidizing effect, it is preferable to add Al, Ti and Si by 0.01% or more in terms of a total content.

Mn is an important element for making the microstructure of the matrix phase of steel according to the present invention. An exemplary structure according to the present invention can be mainly composed of bainite, thus securing a good balance between strength and low temperature toughness. For this reason, the lower limit of its content can be set at 0.8%. When the amount of Mn is too large, however, it becomes difficult to form ferrite in a dispersed manner, and thus, its upper limit can be set at 2.5%.

In addition, a steel according to the present invention can contain Nb of 0.01% to 0.10%, and Ti of 0.005 to 0.030% as obligatory elements. Nb can inhibit the recrystallization of austenite during controlled rolling and form a fine structure, and may contribute to the enhancement of hardenability and thus can render the steel strong and tough. When the amount of Nb is too large, however, HAZ toughness and field weldability may be adversely affected. For this reason, the upper limit of its amount can be set at 0.10%.

Ti forms fine TiN, can inhibit the coarsening of austenite grains during slab reheating and at a HAZ, thus likely making a microstructure fine and improving the low temperature toughness of a base material and a HAZ. Ti may also function to fix solute N in the form of TiN. For these purposes, Ti may be added to the steel by an amount equal to or larger than 3.4N (in mass %). When the amount of Al is small (0.005% or less, for instance), Ti likely brings about the effects of forming oxides, having the oxides act as nuclei for the formation of intra-granular ferrite in a HAZ and making the structure of the HAZ fine. For obtaining those effects of TiN, an addition of Ti to at least 0.005% is preferable. When the amount of Ti is too large, however, TiN likely becomes coarse, and/or the precipitation hardening caused by TiC occurs, thus deteriorating the low temperature toughness of the steel. For this reason, the upper limit of its content can be set at 0.030%.

Al is an element which can be provided in steel as a deoxidizing agent. Al also is effective for making a structure fine. However, when the amount of Al exceeds 0.1%, Al-type nonmetallic inclusions likely increase, thus adversely affecting steel cleanliness. For this reason, the upper limit of its content should preferably be set at 0.1%. Steel can be deoxidized using Ti or Si, and, in this sense, it is not always necessary to add Al. However, for stably obtaining a deoxidizing effect, it is desirable to add Si, Ti and Al by 0.01% or more in terms of a total content.

N forms TiN, and likely inhibits the coarsening of austenite grains during slab reheating and at a HAZ, and thus, improves the low temperature toughness of a base material and a HAZ. It is desirable that the minimum N amount provided for obtaining such effect is 0.001%. However, when solute N exists, dislocations may be fixed by the effect of aging caused by the strain of forming work, and a yield point and yield point elongation come to appear clearly at a tensile test, thus significantly lowering the deformability. It is therefore preferable to fix N in the form of TiN. When the amount of N is too large, TiN likely increases excessively, and certain drawbacks such as surface defects and deterioration of toughness may occur. For this reason, it is preferable to set the upper limit of its content at 0.008%.

Further, according to the present invention, the amounts of P and S, which are impurity elements, can be restricted to 0.03% or less and 0.01% or less, respectively. This is mainly for the purpose of additionally enhancing the low temperature toughness of a base material and a HAZ. A reduction in the amount of P not only decreases the center segregation of a continuously cast slab, and also may prevent intergranular fracture, and thus may improve the low temperature toughness. In addition, a reduction in the amount of S has the effects of reducing MnS, which is elongated during hot rolling, and improving ductility and toughness. It is therefore desirable to make the amounts of both P and S as small as possible. However, the amounts of these elements should be determined in consideration of the balance between required product characteristics and costs for their reduction.

Provided below, the purposes in adding Ni, Mo, Cr, Cu, V, Ca, REM and Mg are explained. In particular, some of the principal purposes in adding these elements to basic component elements are to additionally increase strength and toughness, and expand the size of the steel materials that can be produced, without hindering the excellent characteristics of the steel according to the present invention. Therefore, the additional amounts of these elements should preferably be restricted as a matter of course.

One of the reasons for adding Ni is to improve the low temperature toughness and field weldability of steel according to the present invention, with steel having a low carbon content. The addition of Ni likely has less effect than the addition of Mn, Cr or Mo in forming a hardened structure harmful to low temperature toughness in a rolled structure (for example, in the center segregation band of a continuously cast slab). When the additional amount of Ni is too large, not only the economical efficiency is lowered, and also HAZ toughness and field weldability are deteriorated. For this reason, the upper limit of its addition amount can be set at 1.0%. The addition of Ni is also effective for preventing the Cu-induced cracking during continuous casting and hot rolling. For obtaining such effect, it is preferable to add Ni by not less than one third of a Cu amount. It should be noted that Ni is an optional element, and its addition is not necessary. However, it is desirable to set the lower limit of Ni's content at 0.1%.

The purpose in adding Mo is to improve steel hardenability, and to obtain high strength. Mo is effective also for inhibiting the recrystallization of austenite during controlled rolling and forming a fine austenitic structure, when added together with Nb. However, an excessive addition of Mo likely deteriorates HAZ toughness and field weldability, and makes it difficult to form ferrite in a dispersed manner. For this reason, the upper limit of its amount can be set at 0.6%. It should be noted that Mo is an optional element, and its addition is not required. However, for realizing the effects of the Mo addition as described above stably, it is desirable to set the lower limit of its content at 0.06%.

Cr increases the strength of a base material and a weld. However, when added excessively, Cr may significantly deteriorate HAZ toughness and field weldability. For this reason, the upper limit of Cr amount can be set at 1.0%. It should be note that Cr is an optional element, and its addition is not required. But, to realize the effects of the Cr addition as described above stably, it is desirable to set the lower limit of its content at 0.1%.

Cu increases the strength of a base material and a weld, but, when added excessively, it significantly deteriorates HAZ toughness and field weldability. For this reason, the upper limit of Cu amount can be set at 1.0%. It should be noted that Cu is an optional element, and its addition is not required. However, to realize the effects of the Cu addition as described above stably, it is desirable to set the lower limit of its content at 0.1%.

V has nearly the same effects as Nb, while its effects are weaker than the effects of Nb. It also has an effect of inhibiting the softening of a weld. The upper limit of 0.10% is permissible from the viewpoints of HAZ toughness and field weldability, but a particularly desirable range of its addition is from 0.03% to 0.08%.

Ca and REM likely control the shape of sulfides (MnS), and improve low temperature toughness (e.g., an increase in an absorbed energy at a Charpy test, and so on). When Ca or REM is added in excess of 0.006 or 0.02%, respectively, a large amount of CaO—CaS or REM-CaS is likely formed, and the compound may form large clusters or large inclusions, not only deteriorating steel cleanliness but also adversely affecting field weldability. For this reason, the upper limits of the addition of Ca and REM can be set at 0.006 and 0.02%, respectively. In the case of an ultra-high-strength line pipe, it is particularly effective to lower the amounts of S and O to 0.001% or less and 0.002% or less, respectively, and control the value of ESSP, which is defined as ESSP=(Ca)[1−124(O)]/1.25S, so that the expression 0.5<=ESSP<=10.0 may be satisfied. It should be noted that Ca and REM are optional elements, and their addition is not required. However, to realize the effects of the addition of Ca and REM as described above stably, it is desirable to set the lower limits of the contents of Ca and REM at 0.001 and 0.002%, respectively.

Mg forms finely dispersed oxides, inhibits the grain coarsening in a weld heat-affected zone, and thus improves low temperature toughness. However, when added by 0.006% or more, it likely forms coarse oxides and inversely deteriorates toughness. It should be noted that Mg is an optional element, and its addition is not required. However, to realize the effects of the Mg addition as described above stably, it is desirable to set the lower limit of its content at 0.0006%.

Even if steel has a chemical composition as described above, a desired structure would likely not be obtained unless the appropriate production conditions are utilized. Theoretically, the exemplary method for obtaining a bainitic structure in which fine ferrite is dispersed is provided as follows. Austenite grains flattened in the thickness direction are formed by processing recrystallized grains within an unrecrystallization temperature range. Then, the steel is cooled at a cooling rate that allows ferrite to form in fine grains and then to transform the rest of the structure into a low temperature transformation structure by rapidly cooling. A structure obtained by low temperature transformation of a steel of this type is generally referred to as bainite, bainitic ferrite or the like (collectively referred to herein as bainite).

A steel slab having a chemical composition according to the present invention can be reheated to the austenitic temperature range of about 1,050° C. to 1,250° C., then rough-rolled within the recrystallization temperature range, and subsequently finish-rolled so that the cumulative reduction ratio is 50% or more within the unrecrystallization temperature range of 900° C. or lower temperatures. Then, the rolled steel plate can be subjected to moderately accelerated cooling, as the first stage of cooling, at a cooling rate of about 5 to 20° C./sec. from a temperature not lower than the $Ar_3$ transformation point to a temperature of 500° C. to 600° C., and, by so doing, fine ferrite forms in a dispersed manner. A cooling rate under which fine ferrite may be formed in a dispersed manner varies depending on the chemical composition of a steel, but the cooling rate can be determined by confirming beforehand with a simple test rolling applied to each steel grade.

As the formation of ferrite is completed at 500° C. to 600° C. in the moderately accelerated cooling of the first stage cooling, a low temperature transformation structure mainly composed of a bainite phase can be obtained by, e.g., further subjecting the steel sheet to rapid accelerated cooling and having the rest of the structure transform at a low temperature. For obtaining a dual-phase structure composed of a ferrite phase and a bainite phase, it is preferable to make the cooling rate of the second stage cooling higher than that of the first stage cooling, and a sufficient low temperature transformation is not generated if the cooling rate of the second stage cooling is lower than 15° C./sec. For this reason, the second stage cooling may be determined to be a rapid accelerated cooling having a cooling rate greater than that of the first stage cooling and not lower than 15° C./sec. A desirable cooling rate is about 30° C./sec. or higher. Note that a cooling rate mentioned herein is an average cooling rate at a thickness center. It should be noted that if the second stage cooling is stopped at 300° C. or higher, the low temperature transformation does not complete sufficiently, and, therefore, it is preferable to cool a steel plate to 300° C. or lower. In the case of producing a hot-rolled steel strip, it is preferable to cool the strip at 300° C. or lower after the second stage cooling.

It is desirable to carry out the first stage cooling and the second stage cooling consecutively. However, depending on the layout of the cooling apparatuses, it is possible that the first stage cooling and the second stage cooling are carried out in a discontinued manner between the apparatuses. In such a case, it is preferable to maintain a steel material at a constant temperature or let it cool in air for about 30 sec. or less between the first stage cooling and the second stage cooling. A steel plate thus produced can be further formed into a pipe shape, a seam portion is welded, and a steel pipe may be manufactured in this manner.

In the method for producing a pipe using a steel plate according to the exemplary embodiment of the present invention, UOE method or bending roll method can usually be applied to the steel pipe production, and arc welding, laser welding or the like can be employed as a method for welding a butt portion.

In the method for producing a pipe using a steel strip according to the exemplary embodiment of the present invention, high frequency resistance welding or laser welding can be used after the strip is formed by roll forming. As the uniform elongation of a steel plate tends to be lowered by forming work, it is desirable to carry out the forming work under as low a strain as possible. The steel pipe thus formed is the steel pipe in which: the base material has a structure such that a ferrite phase is dispersed finely and accounts for 5 to 40% in area percentage in a low temperature transformation structure, mainly composed of a bainite phase and the most grain sizes of the ferrite phase are smaller than the average grain size of the bainite phase; and, further, the steel pipe preferably satisfies the conditions that the ratio (YS/TS) of yield strength (YS) to tensile strength (TS) is 0.95 or less and the product (YS×uEL) of yield strength (YS) and uniform elongation (uEL) is 5,000 or more.

The above conditions are preferable for a large diameter steel pipe used for an application according to the present invention. If the value of YS/TS exceeds 0.95, as strength is low and deformation resistance is low, buckling and the like occur when deformation may be imposed. If the value of YS×uEL is less than 5,000, uniform elongation is low and deformability is deteriorated. Therefore, a large diameter steel pipe excellent in deformability and uniform elongation according to the present invention is preferable to satisfy the expressions YS/TS<=0.95 and YS×uEL>=5,000.

Example 1

Steels having the chemical compositions satisfying the exemplary embodiments of the present invention as shown in Table 1 can be melted and refined, rolled and cooled under the conditions shown in Table 2, then formed into steel pipes, and the mechanical properties of the pipes thus obtained were evaluated. The exemplary structures of the base materials and the mechanical properties of the steel pipes are shown in Table 3.

The uniform elongation (uEl) in the longitudinal direction of the steel pipes may be measured as an index of deformability. In the present example, in view of the fact that the uniform elongation tended to increase as strength decreased, deformability can be evaluated as being good even though strength was low when the product (YS×uEL) of yield strength (YS) and uniform elongation (uEL) is 5,000 or more. As another index of the deformability of the steel pipes, the results of buckling tests are also shown.

As provided in Table 3, certain exemplary embodiments of the present invention (e.g., examples 1-14) may have structures in which the ferrite phases accounted for 5 to 40%, and few ferrite grains (10% or less) had sizes larger than the average grain sizes of the bainite phases, and their mechanical properties may satisfy the expressions YS/TS<=0.95 and YS×uEL>=5,000. As a result, the buckling strains may be 1% or more and excellent deformability can be realized.

In contrast, other exemplary embodiments of the present invention (e.g., examples 15-17) do not need to did not satisfy either of the conditions of the ferrite grain size and the conditions of mechanical properties (YS/TS<=0.95 and YS×uEL>=5,000). As a result, their buckling strains may be as low as 1% or less. In the results of tensile tests, the stress-strain curves of the comparative examples clearly demonstrate that the yield point drops, and the existence of yield point elongation may cause the instability of plasticity. Therefore, the defortmability of these steel pipes may significantly deteriorate.

As provided in Table 2, comparative example 15 can be directly subjected to the rapid accelerated cooling without being subjected to a lightly accelerated cooling from a cooling start temperature of not lower than the $Ar_3$ transformation point to a temperature of 500° C. to 600° C. As a result, the example may have a single-phase structure mainly composed of a bainite phase and therefore its uniform elongation may be small. In comparative example 16, the water-cooling termination temperature may be high, and, as a result, the structure formed through low temperature transformation may not be developed sufficiently. As a result, the dual-phase structure of ferrite and bainite likely does not form and uniform elongation can be low. In comparative example 17, the cooling rate at the rapid accelerated cooling of the second stage can be low, and, as a consequence, the structure formed through low temperature transformation, the structure being mainly composed of a bainite phase, may not develop sufficiently. As a result, the dual-phase structure of ferrite and bainite may not necessarily form and uniform elongation may be low.

TABLE 1

| No. | C | Si | Mn | P | S | Nb | Ti | Al | N | Ni | Mo | Cr | Cu | V | others | Ti-3.4N | $Ar_3$ point/ (° C.) | Ceq |
|---|---|---|---|---|---|---|---|---|---|---|---|---|---|---|---|---|---|---|
| A | 0.06 | 0.18 | 1.96 | 0.006 | 0.001 | 0.038 | 0.014 | 0.015 | 0.0028 | | 0.16 | | | | | 0.00448 | 710 | 0.419 |
| B | 0.08 | 0.22 | 1.85 | 0.007 | 0.002 | 0.042 | 0.015 | 0.026 | 0.0031 | | 0.12 | | | | Mg: 0.0013 | 0.00446 | 700 | 0.412 |

TABLE 1-continued

| No. | C | Si | Mn | P | S | Nb | Ti | Al | N | Ni | Mo | Cr | Cu | V | others | Ti-3.4N | $Ar_3$ point/ (° C.) | Ceq |
|---|---|---|---|---|---|---|---|---|---|---|---|---|---|---|---|---|---|---|
| C | 0.04 | 0.15 | 1.44 | 0.008 | 0.002 | 0.045 | 0.016 | 0.003 | 0.0025 | 0.4 | | 0.48 | 0.17 | | | 0.0075 | 720 | 0.414 |
| D | 0.06 | 0.12 | 1.87 | 0.005 | 0.001 | 0.034 | 0.015 | 0.024 | 0.0032 | | | | | 0.04 | Ca: 0.0024 | 0.00412 | 730 | 0.400 |
| E | 0.06 | 0.26 | 1.61 | 0.013 | 0.003 | 0.045 | 0.014 | 0.018 | 0.0034 | 0.3 | | | 0.5 | | REM: 0.0035 | 0.00244 | 740 | 0.382 |
| F | 0.05 | 0.33 | 1.52 | 0.015 | 0.002 | 0.044 | 0.016 | 0.022 | 0.0029 | | 0.25 | | | 0.04 | | 0.00614 | 750 | 0.361 |

$Ar_3$ point is the transformation temperature of a steel sheet 15 to 20 mm in thickness under cooling in air or equivalent.

Ceq = C + Mn/6 + (Ni + Cu)/15 + (Cr + Mo + V)/5

TABLE 2

| | No. | Steel No. | Hot rolling method | Reheating temperature (° C.) | Cumulative reduction ratio at 900° C. or lower (%) | Cooling start temperature (° C.) | Average cooling rate of first stage cooling (° C./sec.) |
|---|---|---|---|---|---|---|---|
| Inventive example | 1 | A | Heavy steel plate | 1150 | 80 | 750 | 15 |
| | 2 | A | Heavy steel plate | 1150 | 80 | 770 | 10 |
| | 3 | B | Heavy steel plate | 1050 | 80 | 730 | 15 |
| | 4 | B | Heavy steel plate | 1050 | 80 | 730 | 15 |
| | 5 | C | Heavy steel plate | 1200 | 80 | 760 | 15 |
| | 6 | C | Heavy steel plate | 1200 | 80 | 760 | 15 |
| | 7 | C | Heavy steel plate | 1100 | 80 | 740 | 10 |
| | 8 | D | Hot-rolled steel strip | 1250 | 80 | 800 | 15 |
| | 9 | D | Heavy steel plate | 1150 | 80 | 760 | 15 |
| | 10 | E | Heavy steel plate | 1050 | 80 | 780 | 15 |
| | 11 | E | Heavy steel plate | 1050 | 80 | 780 | 10 |
| | 12 | F | Heavy steel plate | 1050 | 80 | 780 | 20 |
| | 13 | F | Heavy steel plate | 1050 | 80 | 770 | 15 |
| | 14 | A | Heavy steel plate | 1150 | 80 | 660 | 30 |
| Comparative example | 15 | A | Heavy steel plate | 1150 | 80 | 750 | 35 |
| | 16 | A | Heavy steel plate | 1150 | 80 | 750 | 15 |
| | 17 | B | Heavy steel plate | 1200 | 75 | 650 | 15 |

| | No. | Cooling termination temperature of first stage cooling (° C.) | Time between first and second stages of cooling (sec.) | Average cooling rate of second stage cooling (° C./sec.) | Cooling termination temperature of second stage cooling (° C.) | Pipe size: outer diameter – wall thickness (mm) | Pipe forming method |
|---|---|---|---|---|---|---|---|
| Inventive example | 1 | 550 | Consecutive | 30 | 200 | 762 – 14.3 | UOE |
| | 2 | 600 | Consecutive | 40 | 250 | 914 – 16.0 | UOE |
| | 3 | 550 | Consecutive | 35 | 200 | 1219 – 27 | UOE |
| | 4 | 550 | Consecutive | 35 | 200 | 1219 – 27 | Bending roll |
| | 5 | 550 | 15 | 40 | 200 | 711 – 12.7 | UOE |
| | 6 | 550 | Consecutive | 40 | 200 | 711 – 12.7 | UOE |
| | 7 | 600 | Consecutive | 40 | 250 | 711 – 12.7 | UOE |
| | 8 | 600 | Consecutive | 25 | 300 | 610 – 12.7 | Roll forming |
| | 9 | 500 | Consecutive | 40 | 200 | 762 – 14.3 | UOE |

TABLE 2-continued

| | | | | | | | |
|---|---|---|---|---|---|---|---|
| | 10 | 550 | Consecutive | 20 | 150 | 711 – 12.7 | UOE |
| | 11 | 600 | Consecutive | 35 | 270 | 711 – 12.7 | UOE |
| | 12 | 550 | Consecutive | 40 | 200 | 711 – 12.7 | UOE |
| | 13 | 550 | 15 | 35 | 250 | 711 – 12.7 | UOE |
| | 14 | | | 30 | 150 | 762 – 14.3 | UOE |
| Comparative | 15 | | | 35 | 200 | 762 – 14.3 | UOE |
| example | 16 | 600 | Consecutive | 30 | 420 | 762 – 14.3 | UOE |
| | 17 | 550 | Consecutive | 10 | 200 | 660 – 25.4 | UOE |

TABLE 3

| | No. | Ferrite fraction (%) | Coarse ferrite grains *1) | YS (MPa) | TS (MPa) | YS/TS | Uniform elongation uEl (%) | YS*uEl | Charpy impact value-30° C. (J) | Buckling strain (%) |
|---|---|---|---|---|---|---|---|---|---|---|
| Inventive | 1 | 10 | 1 Scarce | 669 | 725 | 0.923 | 7.5 | 5018 | 223 | 1.1 |
| example | 2 | 15 | Scarce | 665 | 729 | 0.912 | 7.8 | 5187 | 254 | 1.2 |
| | 3 | 15 | Scarce | 611 | 660 | 0.926 | 10.1 | 6171 | 231 | 1.4 |
| | 4 | 15 | Scarce | 608 | 658 | 0.924 | 10.4 | 6323 | 229 | 1.5 |
| | 5 | 35 | Scarce | 532 | 584 | 0.911 | 12.2 | 6490 | 294 | 1.5 |
| | 6 | 30 | Scarce | 527 | 591 | 0.892 | 12.6 | 6640 | 292 | 1.6 |
| | 7 | 25 | Scarce | 537 | 595 | 0.903 | 11.9 | 6390 | 290 | 1.3 |
| | 8 | 25 | Scarce | 567 | 622 | 0.912 | 10.3 | 5840 | 245 | 1.3 |
| | 9 | 25 | Scarce | 596 | 643 | 0.927 | 10.5 | 6258 | 263 | 1.6 |
| | 10 | 20 | Scarce | 501 | 577 | 0.868 | 12.4 | 6212 | 232 | 1.5 |
| | 11 | 25 | Scarce | 516 | 587 | 0.879 | 13.7 | 7069 | 239 | 1.5 |
| | 12 | 15 | Scarce | 494 | 576 | 0.858 | 13.3 | 6570 | 276 | 1.4 |
| | 13 | 25 | Scarce | 503 | 589 | 0.854 | 12.8 | 6438 | 255 | 1.4 |
| | 14 | 35 | Many | 658 | 716 | 0.919 | 8.4 | 5527 | 126 | 1.2 |
| Comparative | 15 | 3 | Scarce | 696 | 740 | 0.941 | 5.5 | 3828 | 194 | 0.6 |
| example | 16 | 50 | ii Present | 611 | 653 | 0.936 | 6.6 | 4033 | 253 | 0.7 |
| | 17 | 40 | Scarce | 598 | 637 | 0.939 | 8.0 | 4784 | 118 | 0.7 |

*1) Fraction in ferrite phase of ferrite grains larger than average grain size of bainite phase

What is claimed is:

1. A steel plate having tensile strength in the width direction of 517 MPa to 990 MPa, the steel plate comprising, in its chemical composition by mass, C: 0.03 to 0.12%, Si: 0.8% or less, Mn: 0.8 to 2.5%, P: 0.03% or less, S: 0.01% or less, Nb: 0.01 to 0.1%, Ti: 0.005 to 0.03%, Al: 0.1% or less, and N: 0.008% or less, so as to satisfy the expression Ti−3.4N>=0, and one or more of:

Ni: 1% or less,

Mo: 0.6% or less,

Cr: 1% or less,

Cu: 1% or less,

V: 0.1% or less,

Ca: 0.01% or less,

REM: 0.02% or less, and

Mg: 0.006% or less, and the balance being Fe and unavoidable impurities, wherein the steel plate has a high degree of a deformability and comprises a low-temperature transformation structure having a ferrite phase which is composed of first grains and a bainite phase which is composed of second grains, the ferrite phase being finely dispersed and accounting for 5 to 40% in area percentage of the structure, wherein the percentage of the ferrite grains larger than the average size of bainite grains is 10% or less in the ferrite phase, wherein the steel plate is produced by a process comprising the steps of:

(a) reheating the steel slab containing the above defined steel compositions to an austenite temperature in the range of 1050 to 1250° C.;

(b) after step (a), rough rolling the reheated steel slab within a recrystallization temperature range;

(c) after step (b), finish rolling the rough rolled steel slab to a steel plate at a cumulative reduction ratio of at least 50% within a non-recrystallization temperature range of at most 900° C.;

(d) lightly accelerated cooling the finish rolled steel plate at a first cooling rate of 5° C./sec to 20° C./sec from a temperature that is not lower than an Ar3 transformation point to a temperature in the range of 500° C. to 600° C.; and (e) immediately after step (d), or after maintaining the hot rolled steel plate at a constant temperature, or letting the hot rolled steel plate cool in air for at most 30 seconds, then heavily accelerated cooling the steel plate at a second cooling rate of at least 15° C./sec that is greater than the first cooling rate to a temperature less than 300° C.

2. A steel pipe having tensile strength in the circumferential direction of 517 MPa to 990 MPa, the steel pipe comprising, in its chemical composition by mass, C: 0.03 to 0.12%, Si: 0.8% or less, Mn: 0.8 to 2.5%, P: 0.03% or less, S: 0.01% or less, Nb: 0.01 to 0.1%, Ti: 0.005 to 0.03%, Al: 0.1% or less, and N: 0.008% or less, so as to satisfy the expression Ti−3.4N>=0, and one or more of:

Ni: 1% or less,

Mo: 0.6% or less,

Cr: 1% or less,

Cu: 1% or less,

V: 0.1% or less,

Ca: 0.01% or less,

REM: 0.02% or less, and

Mg: 0.006% or less, and the balance being Fe and unavoidable impurities, wherein the steel pipe has a high degree of a deformability wherein at least one portion has a ratio of yield strength (MPa) to tensile strength (MPa) of at most 0.95 and a yield strength (MPa) multiplied by uniform elongation (%) (YS×uEL) value of at least 5,000, wherein the steel plate is produced by a process comprising the steps of:

(a) reheating the steel slab containing the above defined steel compositions to an austenite temperature in the range of 1050 to 1250° C.;

(b) after step (a), rough rolling the reheated steel slab within a recrystallization temperature range;

(c) after step (b), finish rolling the rough rolled steel slab to a steel plate at a cumulative reduction ratio of at least 50% within a non-recrystallization temperature range of at most 900° C.;

(d) lightly accelerated cooling the finish rolled steel plate at a first cooling rate of 5° C./sec to 20° C./sec from a temperature that is not lower than an Ar3 transformation point to a temperature in the range of 500° C. to 600° C.; and (e) immediately after step (d), or after maintaining the hot rolled steel plate at a constant temperature, or letting the hot rolled steel plate cool in air for at most 30 seconds, then heavily accelerated cooling the steel plate at a second cooling rate of at least 15° C./sec that is greater than the first cooling rate to a temperature less than 300° C.

3. A steel pipe according to claim 2, wherein the at least one portion is formed from a base material which has a low temperature transformation structure, the structure comprising:

a finely dispersed ferrite phase which is composed of first grains and accounts for 5% to 40% in an area percentage of the structure, and a bainite phase which is composed of second grains, and wherein the percentage of the ferrite grains larger than the average size of bainite grains is 10% or less in the ferrite phase.

* * * * *